US006082898A

United States Patent [19]

Capy et al.

[11] Patent Number: 6,082,898

[45] Date of Patent: Jul. 4, 2000

[54] BAG PRODUCED FROM A THIN PLEATED SHEET PROVIDED WITH SELF-CLOSING MEANS

[76] Inventors: Gilbert Capy, La Botte, F-69640 Jarnioux, France; Akiva Buchberg, 5030 Pine Tree Dr., Miami Beach, Fla. 33140

[21] Appl. No.: 09/269,809

[22] PCT Filed: Jul. 18, 1997

[86] PCT No.: PCT/FR97/01339

§ 371 Date: Apr. 1, 1999

§ 102(e) Date: Apr. 1, 1999

[87] PCT Pub. No.: WO98/15464

PCT Pub. Date: Apr. 16, 1998

[30] Foreign Application Priority Data

Oct. 4, 1996 [FR] France ..... 96 12328

[51] Int. Cl.[7] ..... B65D 33/24

[52] U.S. Cl. ..... 383/87; 383/120; 229/87.03

[58] Field of Search ..... 383/87, 120, 98, 383/99; 229/87.03, 87.08

[56] References Cited

U.S. PATENT DOCUMENTS

| | | | |
|---|---|---|---|
| 2,401,109 | 5/1946 | Rohdin | 383/87 X |
| 3,722,785 | 3/1973 | Rivman | 383/87 X |
| 4,515,840 | 5/1985 | Gatward | 383/87 X |
| 4,528,694 | 7/1985 | Skovgaard | 383/87 X |
| 4,677,684 | 6/1987 | Gatward | 383/87 |
| 5,131,586 | 7/1992 | Capy | 229/87.08 X |
| 5,580,625 | 12/1996 | Capy et al. | 229/87.08 X |

FOREIGN PATENT DOCUMENTS

| | | |
|---|---|---|
| 487142 | 4/1975 | Austria . |
| 0 631 560 B1 | 1/1995 | European Pat. Off. . |
| 2 718 717 | 10/1995 | France . |

*Primary Examiner*—Jes F. Pascua

*Attorney, Agent, or Firm*—Pitney, Hardin, Kipp & Szuch, LLP

[57] ABSTRACT

The bag is made from a pleated sheet comprising asymmetrical pleats and it comprises a closure consisting of two flaps (26, 27) fixed to each other at their ends which are urged to apply against each other when the pleats of the bag are unfolded forcing the flaps (26, 27) to adopt a concave shape which maintains one against the other without any other linking means.

4 Claims, 2 Drawing Sheets

BAG PRODUCED FROM A THIN PLEATED SHEET PROVIDED WITH SELF-CLOSING MEANS

CROSS-REFERENCE TO RELATED APPLICATIONS

This application is a 35 U.S.C. 371 application of PCT/FR97/01339 filed Jul. 18, 1997.

BACKGROUND OF THE INVENTION

1. Field of the Invention

The invention relates to a bag produced from a thin pleated sheet provided with self-closing means.

2. Description of the Related Art

European Patent EP-0-631,560 describes packaging for containing loose products, produced from a thin sheet comprising asymmetrical pleats fixed at their ends, the pleated part being folded on itself perpendicularly to the direction of the pleats to form a simple base or a bellows-type base, leaving an opening whose edges are in line or offset. The pleated part is extended on each side by a non-pleated zone forming two walls which may be fixed to each other. This patent describes several methods of closing the packaging thus obtained:

- a first method of closure relates to a bag comprising, on each side, a welding of the unpleated zones and one of the edges of which is sufficiently offset to be able then to serve as a flap when the bag is full;
- a second method of closure consists in extending a pleated zone laterally by a non-pleated zone of a length sufficient to produce a receptacle when the base is formed and the walls which constitute it are fixed at their ends, whilst the non-pleated part limiting the other end of the fold remains free. Closure is then obtained by unfolding the pleated part over the non-pleated part.

The first method of closure described above applies to a bag which is easily identifiable by the user, but requires the use of a locking means because the flap does not stay in place alone.

The second method of closure is self-locking, but its manipulation requires a manual manoeuvre which users need to learn.

BRIEF SUMMARY OF THE INVENTION

The aim of the present invention is to propose a self-locking closure for a bag produced from a pleated sheet of the same type as that described in European Patent EP-0-631,560, which is hereinafter called "cited patent".

DETAILED DESCRIPTION OF THE INVENTION

Figure 1:
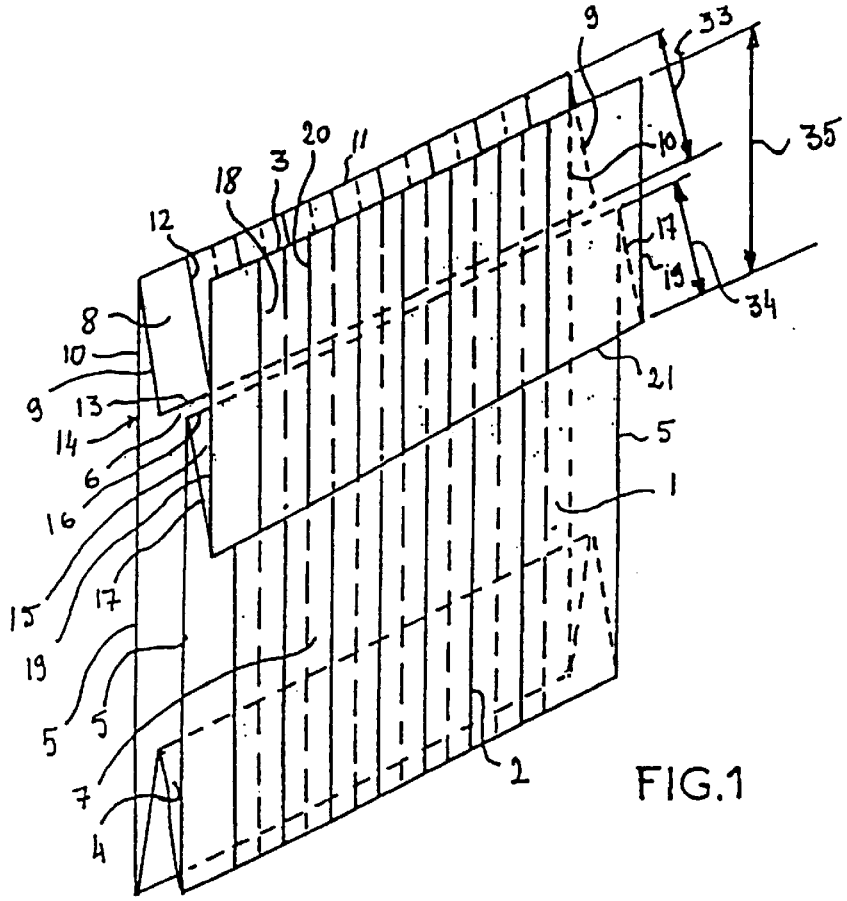
FIG. 1 shows a pleated sheet folded perpendicularly to the direction of the pleats with a view to obtaining the self-closing closure according to the invention, but not yet fixed in the lateral unpleated zones in order clearly to show how the pleats forming the closure are positioned relative to one another.

The invention consists, on the basis of a pleated sheet 1 (FIG. 1) comprising asymmetrical pleats 2 fixed at their ends 3 and 13, in forming a simple or bellows-type base 4 by folding the sheet 1 perpendicularly to the asymmetrical pleats 2 to form the base 4, as described in the cited patent, in such a manner that the unpleated edges 5 of the pleated sheet 1, each forming a face 6 and 7, overlap. One of the edges of the pleated sheet 1, corresponding to the end 13 of the pleats 2, is folded inwards, perpendicularly to the direction of the pleats 2. This forms a first flap 8 whose unpleated edges 9 are fixed to those 10 of the face 6 to which it belongs. The pleats 2 are preferably fixed, at least on one face at the height of the fold 11 of the first flap 8, by adhering to each other the opposite walls in the hollow of each pleat so as to prevent this first flap 8, whose pleats 12 are fixed at least at the two ends 11 and 13, from unfolding during use. The unpleated edges 5 of the two faces 6 and 7 of the bag are fixed from the base 4 up to the height 14 of the end 13 of the first flap 8. A second flap 15 is formed by folding the other face 7 outwards, perpendicularly to the direction of the pleats 2, so that the fold 16 produced is located at the height 14 of the end 13 of the fixing of the unpleated edges 5 of the bag. The edges 17 of this second flap 15 are not fixed to the unpleated edges 5 of the face 7 of the bag over which it is folded down. The second flap 15 is then folded on itself, perpendicularly to the direction of the pleats 2 to form a third flap 18 in such a manner that this third flap overlaps all or part of the first flap 8. The unpleated edges 19 of this third flap 18 are fixed on the one hand to the unpleated edges 17 of the second flap 15 and then to the unpleated edges 9 of the first flap 8. The pleats 20 of the third flap 18 are fixed by adhering to each other the walls which are in mutual contact, in order to form the hollow of the pleats, perpendicularly to the fold 21 located between the second flap 15 and the third flap 18 in such a manner that the pleats 20 which constitute the third flap 18 cannot unfold during use. The end 3 of the third flap 18 and the fold 11 between the first flap 8 and the face 6 from which it is formed form the lips of a self-closing bag.

Figure 2:
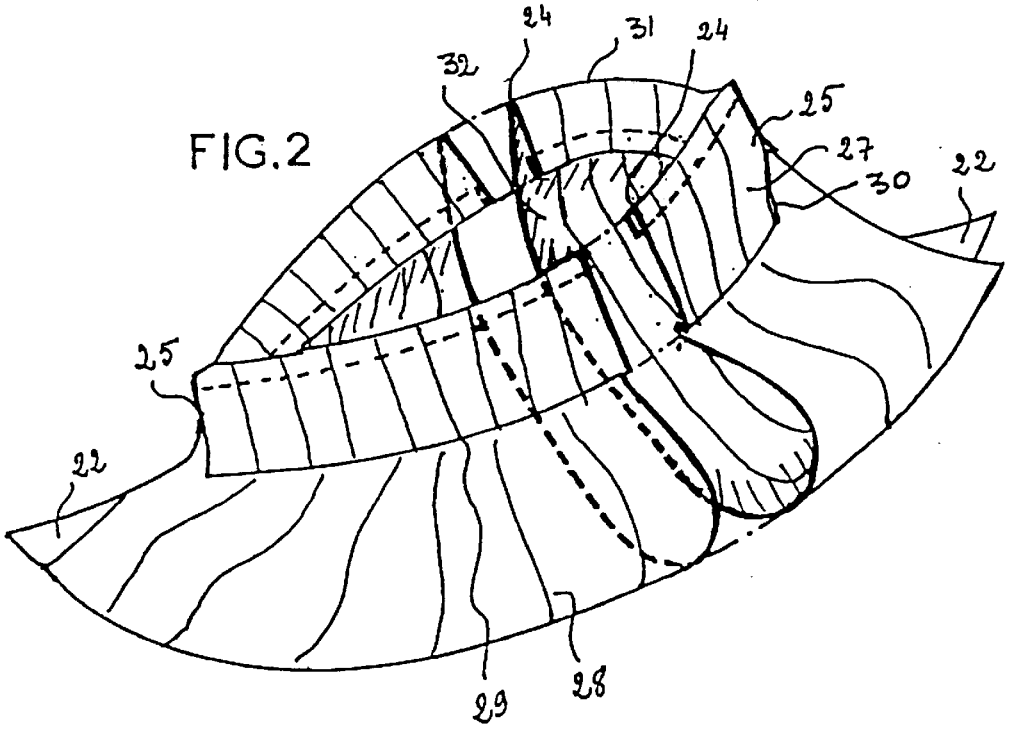
FIG. 2 shows an exploded perspective view of the bag of which the pleats of the base provided with its self-closing closure according to the invention have been unfolded into an open position, in order to allow filling.
Figure 3:
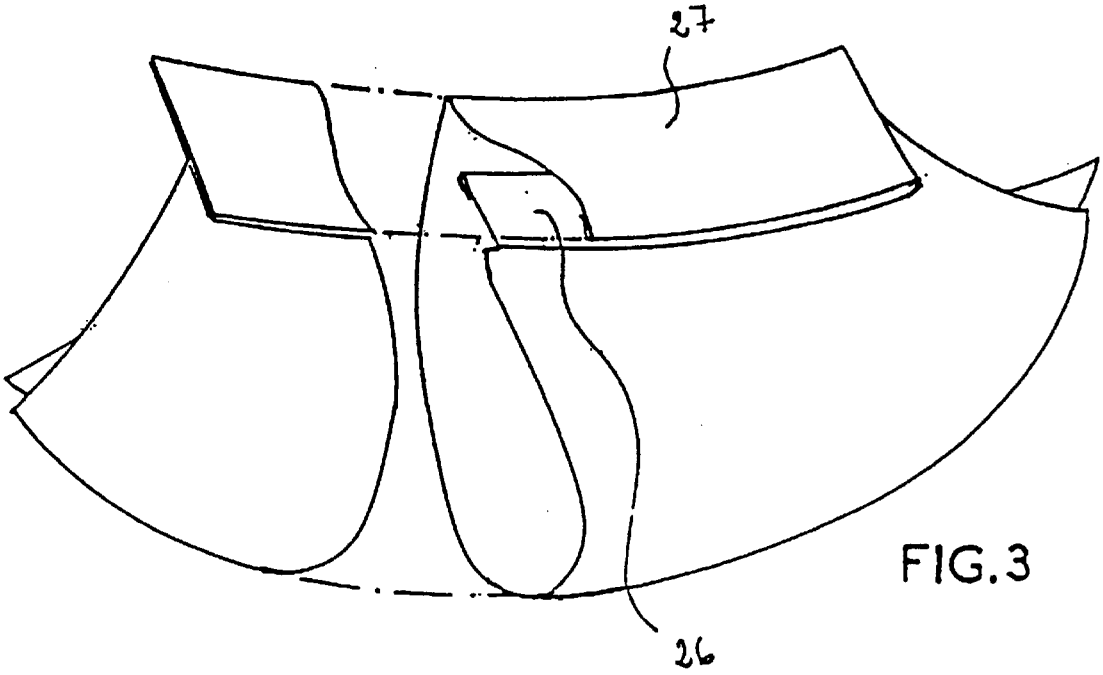
FIG. 3 shows an exploded perspective view of the bag of FIG. 2 with its self-closing closure in the closed position. The pleats have not been shown in this figure in order to make it more legible.

Implementation of such a bag consists, firstly, in separating the pleats 28 by pulling on the corners 22 (FIG. 2) located at the bottom 23 of the bag and in separating the lips 24 of the bag which remain open. It is then possible to fill the bag with loose products which are contained entirely inside the bag in order to allow it to re-close. Once the bag has been filled, it suffices to pull on the edges 25 of the first flap 26 and third flap 27, which are welded to each other. The third flap 27 (FIG. 3) is then applied flat onto the first flap 26 and is maintained applied there, possibly adopting, when the edges 25 are released, a concave shape linked to the fact that the unfolding of the pleats 28 (FIG. 2) gives the bottom 23 of the bag a greater width than that of its top at the level of the fold 29 located between the second flap 30 and the third flap 27 which is the same as that of the fold 31 located between the first flap 26 and the face 32 from which it is formed. Although the unfolding takes place substantially in the manner of a "fan", this gives a hollow shape to the first and third flaps 26 and 27, closing the bag.

In a preferred version of the invention, the width 33 (FIG. 1) of the first flap 8 is equal to the width 33 of the second flap 15 and the third flap 18 has a width 35 equal to the sum of the widths 33 and 34 of the first flap 8 and second flap 15.

Figure 4:
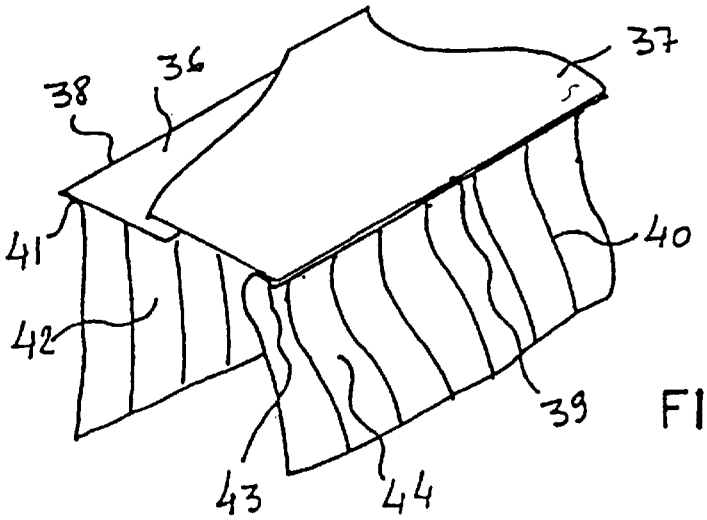
FIG. 4 shows a common length of the self-closing closure according to the invention, in accordance with a variant of the invention.

In a variant of the invention, the first flap 26 (FIG. 3) and the third flap 27 are replaced by non-pleated planar sheets 36 and 37, respectively (FIG. 4), of the same shape as the flaps they replace, which are fixed via their respective edges 38 and 39 perpendicularly to the direction of the pleats 40, in the case of the first flap 36 at the top 41 of the corresponding face 42 and in the case of the third flap 37 at the end 43 of the second flap 44. This method of fixing the first and third flaps 36 and 37 also serves to fix the pleats 40 at their end.

What is claimed is:

1. Self-closing closure device for a bag formed from a pleated sheet comprising a pleated sheet having a first end and a second end, a third end and a fourth end perpendicular to the first and second end, said third and fourth ends having portions thereof that are unpleated, asymmetrical pleats which are affixed to each other at the first and second ends, a bellows-type base formed by folding the sheet perpendicularly to the direction of the pleats to form a first and second face, a first flap located at the first end of the first face being folded inwards along a first fold and having an end perpendicularly to the direction of the pleats and being affixed to the first sheet along a portion of the unpleated third and fourth edges, the first and second faces are affixed along the unpleated portions on the third and fourth ends up to the first flap, a second flap on the second face being folded outwards along a second fold at an approximate height of the end of the first flap, a third flap folded inward perpendicularly to the direction of the pleats at a third fold overlapping the second flap and first flap and affixed to said first and second flaps along the unpleated edges of the third and fourth ends and wherein the pleats located at the first fold and the third fold are affixed together.

2. Self-closing closure device according to claim 1, wherein the width of the first flap is equal to the width of the second flap and the third flap has a width equal to the sum of the widths of the first flap and second flap.

3. Self-closing closure device according to claim 2, wherein the first flap and a third flap comprise non-pleated planar sheets which are fixed to the sheet at the first and third folds respectively.

4. Self-closing closure device according to claim 1, wherein the first flap and a third flap comprise non-pleated planar sheets which are fixed to the sheet at the first and third folds respectively.

* * * * *